US008491264B1

(12) United States Patent
Liang

(10) Patent No.: US 8,491,264 B1
(45) Date of Patent: Jul. 23, 2013

(54) TURBINE BLADE WITH TRAILING EDGE COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 762 days.

(21) Appl. No.: 12/726,527

(22) Filed: Mar. 18, 2010

(51) Int. Cl.
*F01D 5/18* (2006.01)

(52) U.S. Cl.
USPC ..... 416/97 R

(58) Field of Classification Search
USPC ..... 416/95, 96 R, 97 R
See application file for complete search history.

(56) References Cited

U.S. PATENT DOCUMENTS

| | | | | |
|---|---|---|---|---|
| 7,413,406 | B2 * | 8/2008 | Pietraszkiewicz et al. | 416/96 R |
| 8,016,564 | B1 * | 9/2011 | Liang | 416/97 R |
| 2008/0273987 | A1 * | 11/2008 | Liang | 416/97 R |

* cited by examiner

*Primary Examiner* — Edward Look
*Assistant Examiner* — William Grigos
(74) *Attorney, Agent, or Firm* — John Ryznic

(57) ABSTRACT

A trailing edge cooling circuit for a turbine rotor blade, which includes a radial flow cooling channel that supplies cooling air for the T/E region of the blade. Three radial flow cooling channels are located adjacent to one another and connected to the radial flow cooling supply channel, each discharging through an opening along the T/E just underneath the blade tip. The radial flow cooling channels in the T/E region are connected together by rows of metering holes in the middle spanwise height of the blade that produce mixing of the cooling air flowing upward toward the blade tip and improve the cooling effectiveness of the cooling air. A row of exit holes along the T/E discharge cooling air from the third radial flow cooling channel.

6 Claims, 4 Drawing Sheets

TURBINE BLADE WITH TRAILING EDGE COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically for a turbine rotor blade with trailing edge cooling.

2. Description of the Related Art Including Information Disclosed Under 37 CFR 1.97 and 1.98

A gas turbine engine, such as an industrial gas turbine (IGT) engine, a turbine includes one or more rows or stages or rotor blades that react with a hot gas stream. The efficiency of the turbine can be increased by passing a higher temperature gas stream into the turbine. However, the turbine inlet temperature is limited to the material properties of the parts exposed to the hot gas stream. The first stage stator vanes and rotor blades are exposed to the highest temperature gas stream and therefore require the most amount of cooling. However, the second stage vanes and blades also require cooling to prevent hot spots from occurring that can result in erosion and shortened part life.

Complex internal cooling circuits have been proposed to provide cooling for these airfoils and include combinations of conduction cooling, impingement cooling and film cooling. The surface of an airfoil, such as a rotor blade, can be exposed to different temperatures. The leading edge of the blade is exposed to the highest gas stream temperature. The trailing edge region of the airfoil is not exposed to the highest temperature, but is difficult to provide adequate cooling because the airfoil is very thin in this region. A thin airfoil does not provide much internal room for cooling circuits. More effective cooling will lead to a reduced trailing edge metal temperature, which results in a reduced cooling air flow requirement that improves the turbine efficiency.

BRIEF SUMMARY OF THE INVENTION

An airfoil trailing edge cooling circuit that can be incorporated into a prior art airfoil cooling circuit, where the T/E cooling circuit includes multiple radial cooling flow channels which are cast into the airfoil T/E section, the radial channels include cross flow replenishment metering holes at selected locations along the airfoil spanwise height. Cooling air for the multiple radial flow channels is supplied through the main body serpentine flow cooling channel located within the blade root section. The spent cooling air for the multiple radial flow channels is discharged at the blade trailing edge upper span height. Trip strips are incorporated into the side walls of the radial flow channels to enhance the internal cooling performance. axial cooling air replenishment cooling holes are formed along the airfoil trailing edge camber line based on the airfoil spanwise heat load or spanwise radial temperature. The replenishment cooling hole is at an inline array and cascades down in cooling hole size along the axial direction. The replenishment cooling hole is intersected with the multiple radial flow channels to form the multiple turbulence mixing and cooling process to improve the cooling efficiency for the blade trailing edge region.

cooling air for the replenishment cooling hole is fed through the up-pass of the serpentine flow circuit or a single up-pass radial channel located adjacent to the trailing edge region and then impinges onto the first, then second and then third ribs, and then impinges onto the trailing edge exit wall. This design forms a triple radial flow channel design. The impingement jet exits from the first replenishment hole, is expanded within the radial flow channel and thus induces turbulent mixing within the radial flow channel. The cooling air is then contracted through the second replenishment hole and repeats this impingement cooling process into the second and third radial flow channels prior to being discharged through the trailing edge exit cooling holes.

DETAILED DESCRIPTION OF THE INVENTION

Figure 1:
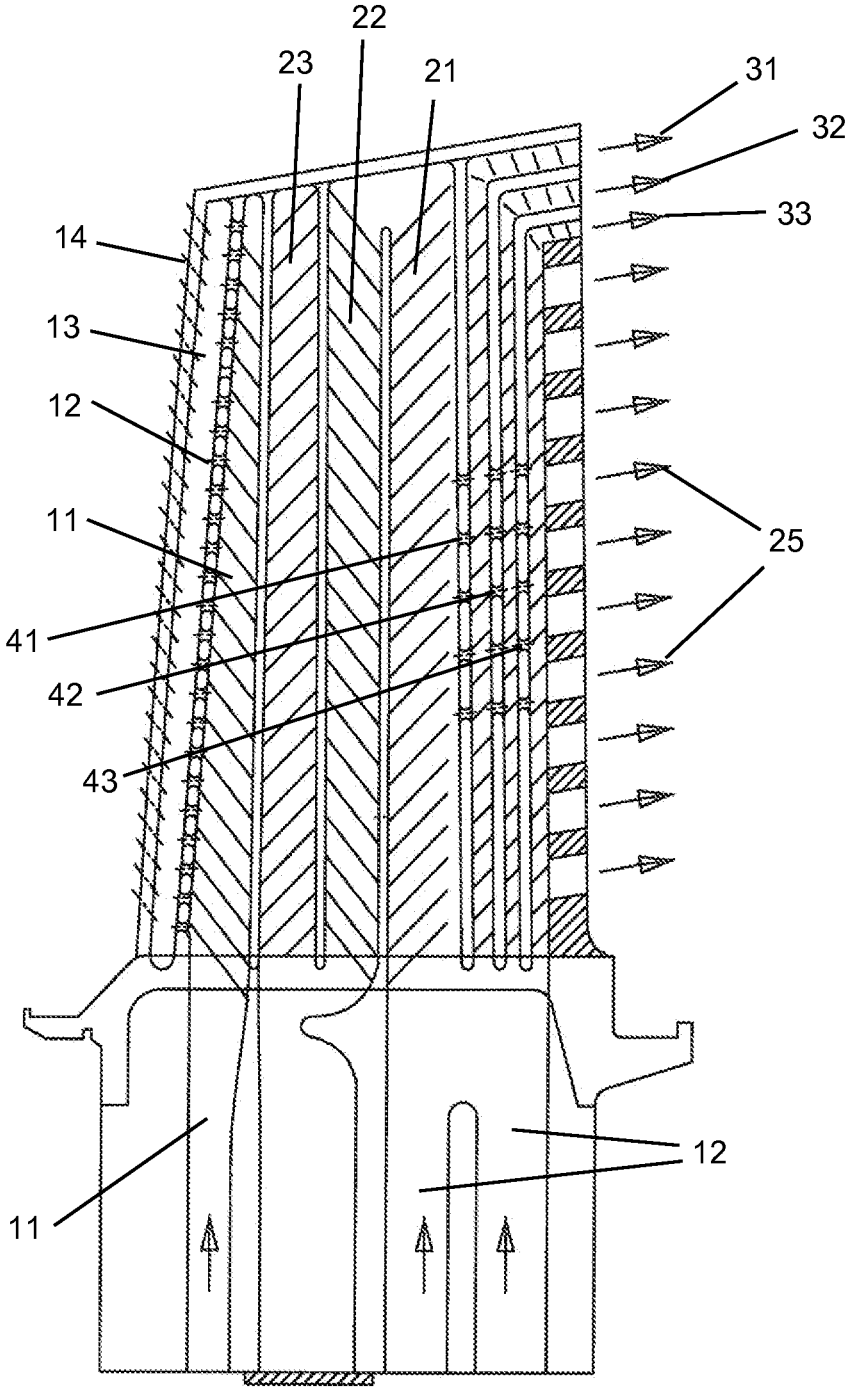
FIG. 1 shows a cross section view from the side of a turbine blade with the cooling flow circuit of the present invention.

A turbine blade for a gas turbine engine, especially for an industrial gas turbine engine, is shown in FIG. 1 and includes a root section with a leading edge cooling supply channel 11 and a cooling supply channel (two channels) 12 for the remaining circuit of the blade. A remaining cooling supply channel in the root is blocked with a cover plate. the leading edge region supplied by the L/E cooling air supply channel 11 includes the prior art cooling circuit of a row of metering and impingement holes 12 that discharge cooling air into a L/E impingement cavity 13 to provide impingement cooling of the backside surface of the leading edge region of the airfoil. A showerhead arrangement of film cooling holes 14 discharge the spent cooling air from the L/E cavity 13.

Figure 2:
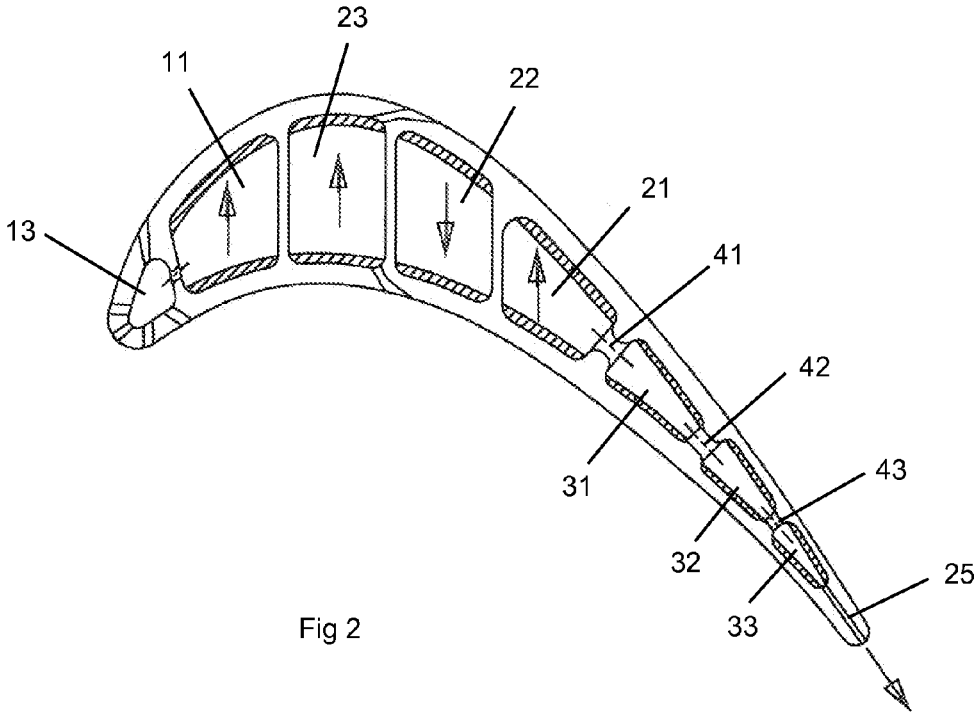
FIG. 2 shows a cross section view of the turbine blade cooling circuit of FIG. 1 at around a spanwise middle section.

FIG. 1 also shows a forward flowing three-pass serpentine flow cooling circuit with a first leg 21 located adjacent to a trailing edge (T/E) region of the airfoil, a second leg 22 and a third leg 23 located adjacent to the L/E region of the airfoil. As seen in FIG. 2, the third leg 23 is connected to two rows of film cooling holes located on the pressure side wall and the suction side wall to discharge the remaining cooling air from the third leg 23.

The T/E region cooling circuit of the present invention includes three radial flow cooling channels connected to the root cooling air supply channel 12, where the three radial flow channels 31-33 are separated by radial ribs and where each radial channel discharges out along the trailing edge of the airfoil in the upper spanwise height just under the blade tip as seen in FIG. 1. The three radial flow channels 31-33 include rows of replenishment or metering cooling holes 41-43 formed in the radial ribs that connect the three adjacent radial flow channels 31-33 in the middle of the spanwise height of the airfoil. The third of the radial flow channels 33 is also connected to a row of T/E exit holes or slots arranged along the trailing edge or on the pressure side wall just before the trailing edge. FIG. 2 shows a cross section view of the blade cooling circuit of the present invention. Trip strips are formed along the walls of the serpentine flow channels and the radial flow channels in the T/E region.

Figure 3:
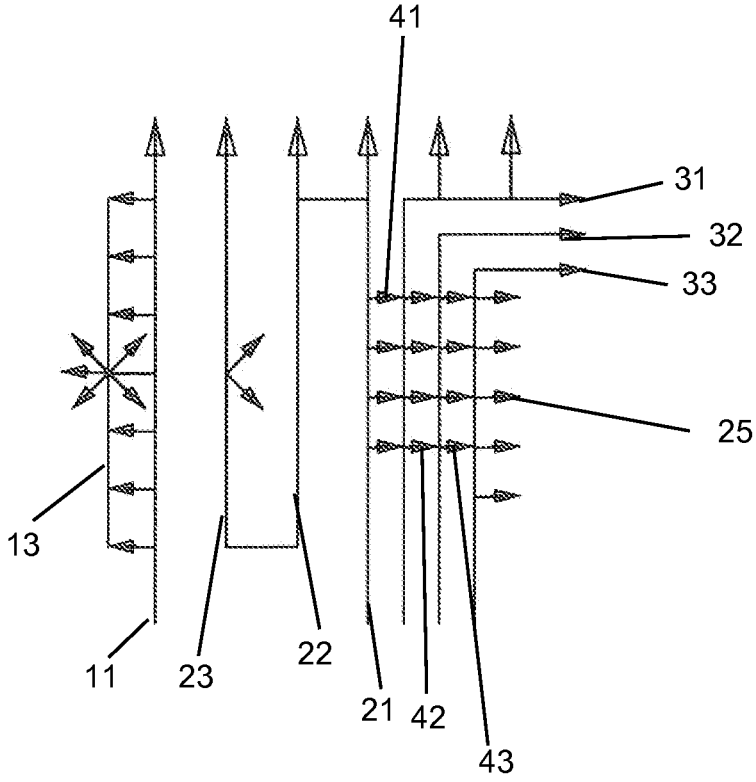
FIG. 3 shows a flow diagram of the cooling flow circuit of the present invention.
Figure 4:
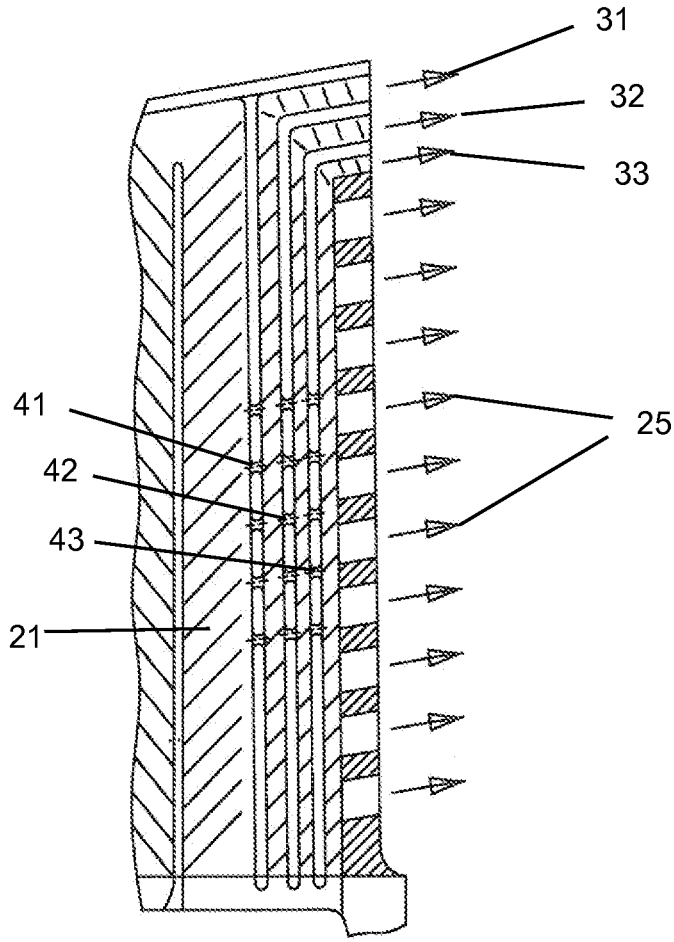
FIG. 4 shows a cross sectional side close-up view of the trailing edge cooling circuit of the present invention.
Figure 5:
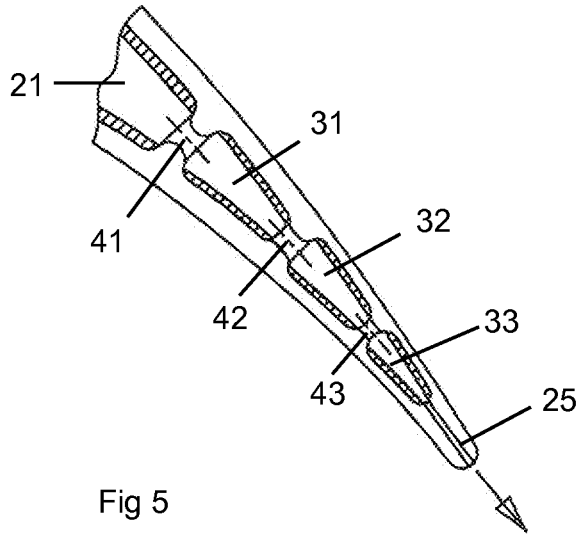
FIG. 5 shows a cross sectional spanwise view of the trailing edge cooling circuit of the present invention.

FIG. 3 shows a flow diagram of the cooling flow circuit of the present invention of FIGS. 1 and 2. FIG. 4 shows a close-up view of the T/E cooling circuit of the present invention. The three radial flow channels 31-33 are separated by radial ribs that extend across the T/E cooling channel from the P/S wall to the S/S wall as seen in FIG. 2. The radial flow channels 31-33 would be completely disconnected except for the replenishment cooling holes 41-44 that will be described below. FIG. 5 shows a close-up view of the T/E cooling circuit of the present invention. The replenishment or metering cooling holes 41-43 are inline with the row of adjacent holes and cascade down in the cooling hole side along an axial direction. The holes 41-43 intersect with the multiple radial flow channels 31-33 to form a multiple turbulence and mixing process to improve the cooling efficiency for the blade trailing edge region.

Cooling air for the replenishment or metering cooling holes 41-43 is delivered through the first leg 21 of the serpentine flow cooling circuit, or through a single radial pass cooling channel if not serpentine flow circuit is used for the airfoil. Some of the cooling air from the radial channel 21 will flow through the first row of replenishment holes 41 and onto the adjacent radial rib to provide impingement cooling for this region of the trailing edge region, and then is mixed with the cooling air flowing upward in the second radial flow channel 32. Some of the cooling air flowing in the second radial flow channel 32 will flow through the second row of replenishment holes 42 to produce impingement cooling of the next radial rib and is then mixed with the cooling air flowing upward in the third radial flow channel 33. Most of the cooling air flowing in the third radial flow channels 33 is discharged through the row of T/E exit holes or slots 25, with the remaining cooling air discharging out at the end of the third radial flow channel 33 along the T/E above the row of exit holes or slots 25. the cooling air flowing in the three radial flow channels 31-33 that is not passed through the replenishment holes 41-44 or the T/E exit holes 25 will be discharged out through the opening hole at the end of the respective radial flow channel. The cooling air flowing through the replenishment holes 41-43 will provide impingement cooling to the P/S and S/S walls of the channels as well as the ribs to provide more turbulent mixing and cooling than the prior art T/E region cooling circuits.

With the T/E region cooling circuit of the present invention, the usage of the cooling air is maximized for a given airfoil T/E region heat load and pressure profile. also, the multiple radial flow channels in combination with the multiple replenishment impingement jet and turbulence mixing yields a higher convection cooling effectiveness than would the prior art triple impingement cooling circuit.

I claim the following:

1. A turbine rotor blade comprising:

a trailing edge region with a first radial flow cooling channel with a discharge opening on a trailing edge of the blade adjacent to a blade tip;

a second radial flow cooling channel located adjacent to the first radial flow cooling channel, the second radial flow cooling channel having a discharge opening below the discharge opening of the first radial flow cooling channel;

a third radial flow cooling channel located adjacent to the second radial flow cooling channel, the third radial flow cooling channel having a discharge opening below the discharge opening of the second radial flow cooling channel;

a fourth radial flow cooling channel located adjacent to the first radial flow cooling channel and connected to a cooling air supply passage formed within a root section of the blade;

a first row of metering holes that connect the fourth radial flow cooling channel to the first radial flow channel;

a second row of metering holes that connect the first radial flow cooling channel to the second radial flow channel; and, a third row of metering holes that connect the second radial flow cooling channel to the third radial flow channel.

2. The turbine rotor blade of claim 1, and further comprising:

a row of trailing edge exit holes connected to the third radial flow cooling channel.

3. The turbine rotor blade of claim 1, and further comprising:

the openings for the first, second and third radial flow cooling channels are located adjacent to each other and positioned between the blade tip and a row of trailing edge exit holes.

4. The turbine rotor blade of claim 1, and further comprising:

the fourth radial flow cooling channel is a first leg of a forward flowing serpentine flow cooling circuit formed within a main body of the airfoil of the blade.

5. The turbine rotor blade of claim 1, and further comprising:

the first and second and third rows of metering holes are located in a middle third of the airfoil spanwise height of the airfoil.

6. The turbine rotor blade of claim 1, and further comprising:

the first and second and third rows of metering holes are aligned with each other in the airfoil spanwise height.

* * * * *